US007004425B2

(12) United States Patent
Okada et al.

(10) Patent No.: US 7,004,425 B2
(45) Date of Patent: Feb. 28, 2006

(54) FLYING BODY FOR FIRING FROM A TUBE WITH OVER-CALIBER STABILIZERS

(75) Inventors: Shinichi Okada, Yokohama (JP); Sadao Okawa, Toyohashi (JP); Masato Shinomiya, Yokohama (JP); Makoto Mochizuki, Kamakura (JP)

(73) Assignee: Diehl Munitionssysteme GmbH & Co. KG, Roethenbach (DE)

( * ) Notice: Subject to any disclaimer, the term of this patent is extended or adjusted under 35 U.S.C. 154(b) by 0 days.

(21) Appl. No.: 10/504,116

(22) PCT Filed: Feb. 6, 2003

(86) PCT No.: PCT/EP03/01151

§ 371 (c)(1),
(2), (4) Date: Aug. 9, 2004

(87) PCT Pub. No.: WO03/067176

PCT Pub. Date: Aug. 14, 2003

(65) Prior Publication Data

US 2005/0145750 A1 Jul. 7, 2005

(30) Foreign Application Priority Data

Feb. 7, 2002 (DE) ..... 102 05 043

(51) Int. Cl.
*B64C 5/12* (2006.01)

(52) U.S. Cl. ..... 244/3.29; 244/49
(58) Field of Classification Search ..... 244/3.23–3.3, 244/49
See application file for complete search history.

(56) References Cited

U.S. PATENT DOCUMENTS 2,793,591 A * 5/1957 Raymond ..... 244/3.29
3,177,809 A * 4/1965 Russell-French ..... 244/3.29
3,196,793 A * 7/1965 Veljko et al. ..... 244/3.28
3,944,168 A 3/1976 Bizien et al.

(Continued)

FOREIGN PATENT DOCUMENTS

DE 34 32 614 A1 3/1986

(Continued)

*Primary Examiner*—Galen Barefoot
(74) *Attorney, Agent, or Firm*—Laurence A. Greenberg; Werner H. Stemer; Ralph E. Locher

(57) ABSTRACT

A missile to be fired from a barrel contains a tail, a tail sleeve attached to the tail, a stop element fixed to the tail sleeve, and a movable structural part disposed at the tail. Fin assembly wings are provided and are to be released from a subcaliber launch position to an overcaliber functional position by the movable structural part moving toward the stop element through a given distance. A pressure area is disposed between the tail end surface and the movable structural part. A propellant gas enters the pressure area during the firing of the missile, for moving the movable structural part away from the tail end surface against the stop element after firing. Bearing shafts are supported by the tail sleeve, the fin assembly wings are configured as a wrap around tail fin assembly held about the bearing shafts.

14 Claims, 4 Drawing Sheets

U.S. PATENT DOCUMENTS

| | | | | |
|---|---|---|---|---|
| 4,004,514 | A * | 1/1977 | Daniels | 102/384 |
| 4,659,037 | A | 4/1987 | Unterstein | |
| 4,702,436 | A | 10/1987 | Arnell | |
| 4,728,058 | A | 3/1988 | Brieseck et al. | |
| 4,860,969 | A | 8/1989 | Muller et al. | |
| 5,082,203 | A | 1/1992 | Baubry | |
| 6,336,609 | B1 * | 1/2002 | Johnsson | 244/3.29 |
| 6,796,525 | B1 * | 9/2004 | Johnsson et al. | 244/3.28 |
| 2001/0030260 | A1 | 10/2001 | Niemeyer et al.. | |
| 2004/0217227 | A1 * | 11/2004 | Alculumbre et al. | 244/3.28 |

FOREIGN PATENT DOCUMENTS

| | | | |
|---|---|---|---|
| DE | 35 07 677 | A1 | 9/1986 |
| DE | 37 21 512 | C1 | 3/1989 |
| DE | 100 15 514 | A1 | 10/2001 |

* cited by examiner

FLYING BODY FOR FIRING FROM A TUBE WITH OVER-CALIBER STABILIZERS

CROSS REFERENCE TO RELATED APPLICATION

This application is a national stage application of International Application No. PCT/E03/01151, filed Feb. 6, 2003, under 35 U.S.C. § 371.

BACKGROUND OF THE INVENTION

Field of the Invention

The invention relates to a missile which can be fired like a mortar from a barrel and, based on the preamble of claim 1, is equipped with a fin assembly which can be deployed to an overcaliber functional position and which may be gliding wings or, in particular, tail control surfaces or stabilizers.

When a missile with an overcaliber fin assembly is fired from a barrel, the process of deploying the stabilizers (which, for example, are articulated on the tail of the missile) is not initiated until the missile has left the barrel. Unlocking devices, matched to the respective structure, are known especially for this purpose. By way of example, DE 34 32 614 A1 discloses a missile having an inflatable body which is folded up in the rest state and has a high-pressure gas from a pressurized container applied to it in order to unfold the missile wings, as a result of which it expands in the radial direction, and thus exerts a force on the folded-up wings.

US 2001/030260 A1 discloses the arrangement of a structural part, which is in the form of a piston, such that it can move within a tail sleeve on the missile, such that a pressure area remains free between the piston and a tail end surface of the missile and which is filled with high-pressure propellant gas in a manner which is not described in any more detail in the course of the missile being launched from its launch barrel. On leaving the muzzle of the barrel, this leads to a pressure which is very much higher than the surrounding atmospheric pressure, so that the piston is moved to a stop element, in the opposite direction to the launch movement. In this position, the entire length (which is subsequently telescopic) of folding wings which are mounted on the piston at the rearward end leave the tail sleeve so that they can now swivel radially outwards to their overcaliber position. However, this results in the major structural and functional risk of the folding wings being mounted axially well behind the end of the tail sleeve which, owing to lack of effective longitudinal guidance of the piston which is moved against the stop, can lead to instabilities, which have an adverse effect on flight, owing to the load on the wings in the free-flight incident flow.

Rather than for retention of folding wings in their subcaliber launch position in the barrel, for deployment of the wings after leaving the barrel, U.S. Pat. No. 4,702,436 A discloses the use of a pot, which is filled with high-pressure propellant gas from the weapon barrel during the launching process, being allowed to rest against a pivoting lever on the folding wings, so that the relative sudden pressure rise on leaving the muzzle of the barrel forces the folding wings to swivel outwards to the overcaliber functional position as a result of the axial movement of the pot. Because no provision is made for active retention of the folding wings in their subcaliber launch position, so that, in practice, it cannot be expected that the wing edges will slide along the inner wall of the barrel during the acceleration in the firing barrel, there is a risk of damage to the wing edges, which are important for the flow behavior, and this damage can lead to the missile having an unstable free-flight behavior.

DE 35 07 677 A1 discloses a missile having a fin assembly in particular in the form of control surfaces which are held on the tail structure such that they can swivel and are articulated transversely with respect to the missile longitudinal axis, which ensures that the control surfaces are held in a position matching the caliber until after firing from the barrel, and which control surfaces can then be released in a defined manner after firing. In this case, interlocks by means of locking pins are provided between each control surface end surface and the casing surface of the tail structure for this purpose. The acceleration during firing results in each locking pin being moved against its holder, thus allowing the respective control surface to swivel out to its overcaliber functional position.

A missile with an overcaliber fin assembly, whose control surfaces are folded into the missile structure for storage, for transport and for launch, and are locked at the end in this position-until they are allowed to unfold from a locked position by virtue of the launch acceleration is also known, by way of example, from DE 37 21 512 C1. In order to produce a physically small, functional safety device which releases all of the control surfaces for deployment at the same time—but not too early—a ram is provided, which engages in all of the control surfaces at the same time, can be moved axially with respect to them in the launch direction, but does not move to the release position for all of the control surfaces at the same time until the missile launch acceleration has been reduced.

As a consequence of their locking devices, which have to be designed specifically for the particular fin assembly, all of these known missiles have a more or less complex configuration. In order to avoid such a relatively complicated configuration, it is also known, in the case of missiles which are fired from a smooth barrel, that is to say a barrel without any rifling, for the fin assembly surfaces (which are provided at the tail of the missile and can be deployed from a folded-up storage or launch position to an unfolded functional position, that is to say flight position, simply to be allowed to rest radially against the smooth inner casing surface of the barrel when in the folded-up position. This is particularly expedient when these fin assembly surfaces are not control surfaces (so-called fins) or wings which are articulated about axes transversely with respect to the longitudinal direction of the missile such that they can be swiveled out in or in the opposite direction to the launch direction, but are so-called wrap around tail fin assemblies. In the case of fin assemblies such as these, fin assemblies in the form of shells rest on the casing surface of the tail structure of the missile when in the launch position, with a matching caliber. They are forced with a certain amount of prestressing radially over a large area against the interior of the barrel, in order then to swivel out about axes parallel to the longitudinal axis of the missile when they are mechanically released as a consequence of leaving the launch barrel.

However, if a missile is intended to be spin-stabilized, and therefore is intended to be fired from a barrel equipped with rifling, then the extreme acceleration forces which occur in the barrel make it impossible to avoid damage caused by the rifling cutting into the fin assembly surfaces as they slide along the rifling, and this can critically influence the functionality of the missile in free flight after this, for example because the directional stability is adversely affected.

SUMMARY OF THE INVENTION

Against the background of the knowledge of these features, the invention is based on the object of providing a missile, particularly in the form of a spin-stabilized mortar round, which has a simple design, with the wings which are provided at the tail of the missile being fixed reliably and securely by means of simple design measures in the folded-up subcaliber, launch or storage position, and the wings being reliably released in order to deploy to their overcaliber functional position after leaving the barrel.

According to the invention, this object is achieved by the features of claim 1. Preferred refinements and developments of the missile according to the invention are specified in the dependent claims.

The missile (which, according to the invention, is equipped with a locking pot for holding fin assembly surfaces in the subcaliber position) has the advantage that the locking pot reliably and securely fixes the wings, which are provided at the tail of the missile, in the folded-up storage or launch position. The locking pot thus also has an optimum protection function with regard to handling requirements in a magazine. This protection function relates not only to the fin assembly surfaces which have been mentioned, but also to further missile ballistic and sensor structures which are located on the tail side of the propellant charge gas area in the barrel. A further very major advantage of the missile equipped according to the invention is that the locking pot is reliably moved from its holding position to the release position, without the use of any external energy, immediately after the missile emerges from the barrel, in order thus to allow the control surfaces or fin assembly surfaces such as these to deploy. This is achieved by means of the increased pressure of the propellant gases which are produced behind the missile in the barrel by the burning propellant means in order to fire the missile from the barrel. This pressure can briefly reach orders of magnitude of up to 100 bar or more. The high-pressure propellant gas passes through the propellant gas inlet in the pot base of the locking pot into the interior of the locking pot behind the missile tail. After leaving the barrel, this high pressure inside the pot is suddenly opposed only by the atmospheric pressure, so that the locking pot is quickly and reliably moved from the holding position to the release position by the internal increased propellant gas pressure, thus allowing the wings or a fin assembly such as this to swivel out to their or its overcaliber functional position. This process of swiveling out takes place under the influence of the centrifugal forces of the missile which has been fired such that it spins, and can be further assisted in a known manner by suitable drive systems such as spring elements, a pyrotechnic force element, or the like. The locking pot remains at the tail of the missile, that is to say one advantageous feature is that there are no parts which fly away with the missile according to the invention.

In the missile according to the invention, holding pins for the fin assembly wings can project outwards from the pot casing of the locking pot. If the missile is designed in this way, the fin assembly wings may be designed to have axially oriented cutouts for the holding pins at their rear edge, which is oriented in the circumferential direction. Another option is for the fin assembly wings to have attachments for the holding pins, with these attachments projecting away from their distal, axially oriented longitudinal edge. The holding pins may each have a pin which projects radially away from the pot casing and, at the distal end of the respective pin, a holding member (which is oriented axially forwards) for the fin assembly wings. The holding pins are in this case designed to be subcaliber.

Each of the cutouts at the rear edge of the fin assembly wing may have a longitudinal extent which is slightly greater than the axial longitudinal extent of the holding member of the associated holding pin, in order to reliably release the respective fin assembly wing when the locking pot is moved from its holding position to its release position by the propellant gas. In order to ensure that the locking pot is held captive on the missile according to the invention, a stop element (which defines the release position of the locking pot) may be provided behind the locking pot at the tail of the missile, and is located at an axially defined distance from the rear tail end surface of the missile.

In the case of the missile according to the invention, it is also possible for a shear pin, which has a weak point to project radially inwards from the respective fin assembly wing and can be sheared off by means of a shearing section on the pot casing of the locking pot. In this case, the pot casing of the locking pot may have projections, which project radially and form shearing sections, by means of which the shear pins of the fin assembly wings can be sheared off at their weak points.

The stop element, which defines the release position of the locking pot may be formed by a ring which is attached to the rear end of a tail sleeve, with the internal diameter of the ring being smaller than the internal diameter of the tail sleeve. The tail sleeve may have elongated holes through which the holding pins extend. The holding sleeve may also have axially oriented longitudinal cutouts, in each of which a bearing element is provided for an associated fin assembly wing. The fin assembly wings are so-called wrap around tail fin assembly wings.

The ring may have an external thread, with the tail sleeve having an internal threaded section matched to it, in order to attach the stop element, which is formed by a ring, to the tail sleeve.

According to the invention, the pot casing of the locking pot may be provided such that it can move axially between the holding position and the release position, between the cylindrical inner surface of the tail sleeve and a cylindrical surface of the tail. At least one sealing ring may be provided between the cylindrical surface of the tail and the pot casing of the locking pot.

The missile which can be fired according to the invention from a barrel thus has a very simple design in order to ensure that its tail fin assembly is still in the subcaliber position during launching, with the locking pot not only having a protection function for the fin assembly, which must still be held folded up, and tail ballistic and sensor structures, but, furthermore, also ensuring that the tail fin assembly of the missile is released reliably. Jettisoning of the locking pot from the tail of the missile is in this case advantageously prevented.

Further details, features and advantages will become evident from the following description of exemplary embodiments, which are illustrated in the drawing, of the missile according to the invention and of major details of the missile.

DESCRIPTION OF THE PREFERRED EMBODIMENTS

Figure 1:
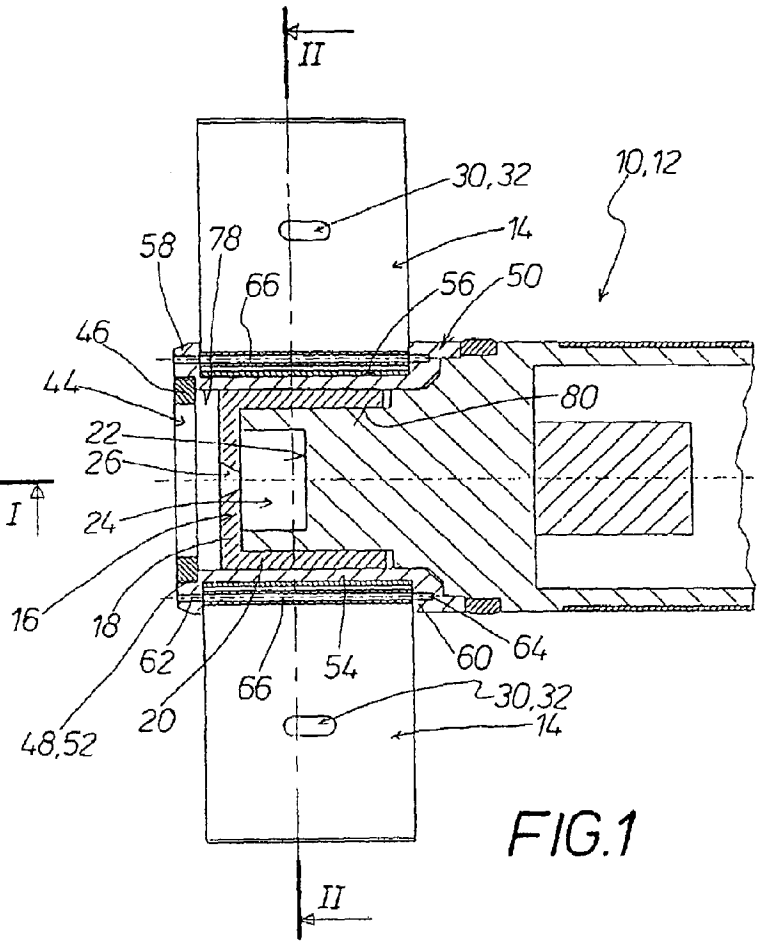
FIG. 1 shows a longitudinal section through one embodiment (a detail of which is shown) of the missile and of its tail section along the section line I—I in FIG. 2.

FIG. 1 shows a detail in the form of a longitudinal section of the tail 10 of a missile 12 which can be fired from a barrel. As can be seen from FIG. 2, wrap around fin assembly wings 14 are provided at the tail 10 of the missile 12, and can be moved from a subcaliber launch position (see FIG. 3, upper half of the drawing) to an overcaliber functional position (see FIGS. 1 and 2 and the lower half of the drawing in FIG. 3).

A locking pot 16 is provided at the tail 10, and has a pot base 18 and a pot casing 20. The fin assembly wings 14 are held in their launch position with the aid of the locking pot 16.

There is a pressure area 24 between the rear tail end surface 22 of the tail 10 of the missile 12 and the pot base 18 of the locking pot 16. The pot base 18 has a propellant gas inlet 26, which opens into the pressure area 24. When the missile 12 is fired from a barrel, which is not shown, propellant gas is forced through the propellant gas inlet 26 into the pressure area 24, thus resulting in a correspondingly high pressure in the order of magnitude of up to 100 bar or more in the pressure area 24. Immediately after leaving the barrel, the pressure difference between the external environmental pressure and the high propellant gas pressure in the pressure area 24 comes into effect, as a result of which the locking pot 16 is moved axially backwards from the holding position (which is shown in FIG. 1 and in the upper half of the drawing in FIG. 3) to a release position. This is indicated by the arrow 28 in the upper half of the drawing in FIG. 3.

Figure 3:
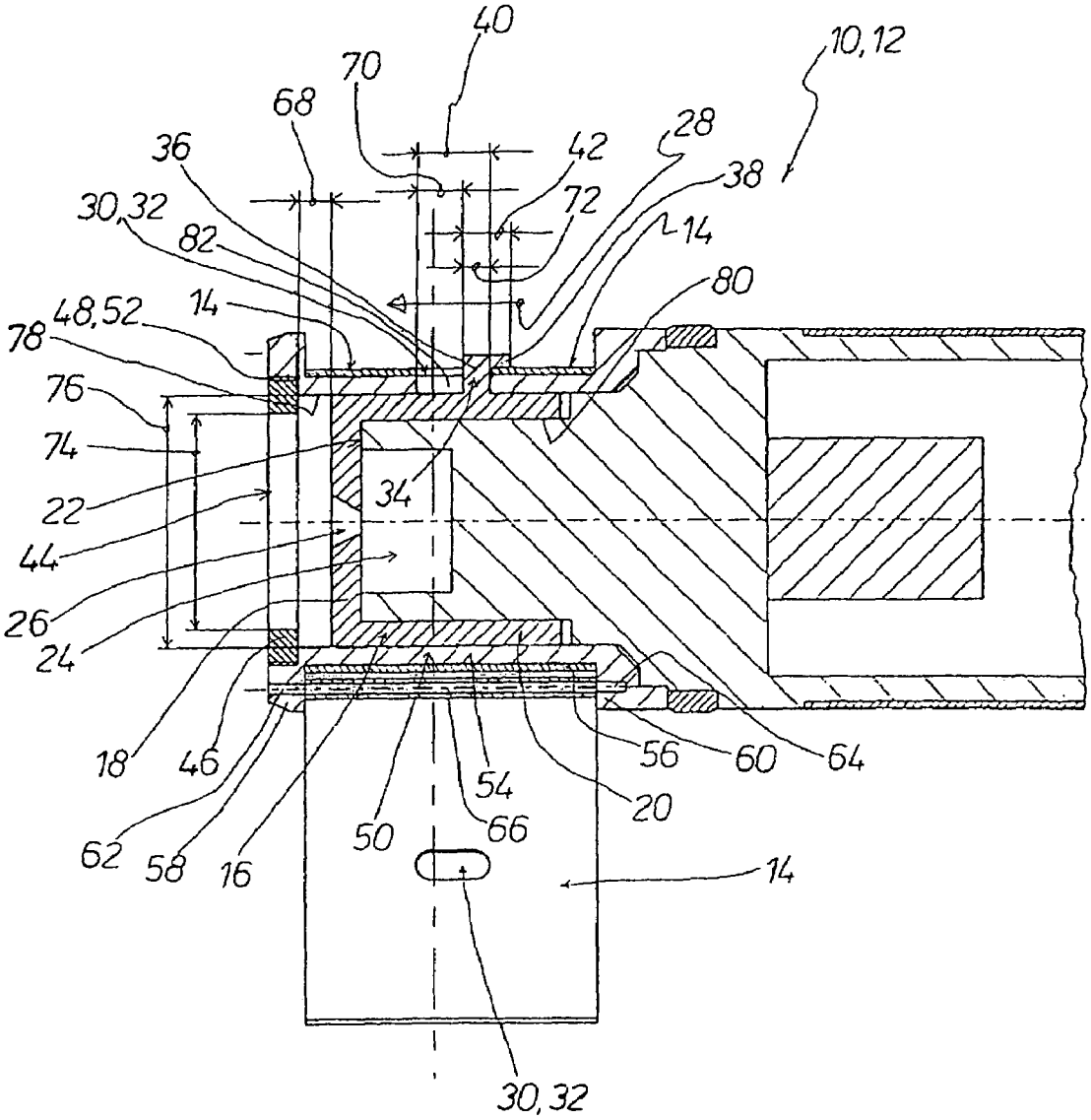
FIG. 3 shows a section along the angled section line III—III in FIG. 2, in order to illustrate the locking pot with holding pins, with the corresponding fin assembly wing being shown in the upper half of the drawing, with the aid of the associated holding pin, which is in the holding position, in the subcaliber launch position while the lower half of the drawing shows the corresponding fin assembly wing in its released, overcaliber functional position.
Figure 4:
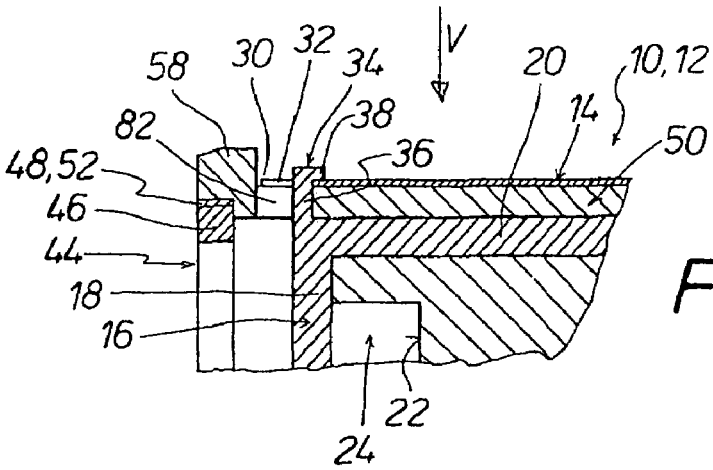
FIG. 4 shows, in the form of a longitudinal section, a detail view corresponding to the upper half of FIG. 3.
Figure 5:
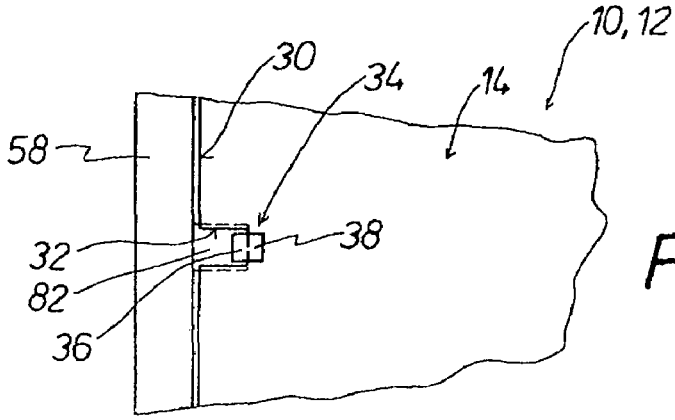
FIG. 5 shows a view of the missile detail shown in FIG. 4, looking in the direction of the arrow V, that is to say viewed from above.

At its rear edge 30 running in the circumferential direction, each fin assembly wing 14 has an axially oriented cutout 32 (see FIGS. 3, 4 and 5). Holding pins 34 project outwards from the pot casing 20 of the locking pot 16. One of these holding pins 34 is shown in the upper half of the drawing in FIG. 3. Each holding pin 34 has a pin 36, which projects radially away from the pot casing 20, and, at the distal end of the pin 36, a holding member 38, which is oriented axially forwards. When the locking pot 16 is in the holding position, the holding member 38, which is oriented forwards, grips the associated fin assembly wing 14 and holds it firmly in the subcaliber launch position. Once the missile has left the barrel and the propellant gas pressure in the pressure area 24 comes into effect, the locking pot 16 is moved axially backwards, away from the rear tail end surface 22. In the process, the holding pins 34, which project away from the locking pot 16, are moved backwards in a corresponding manner, so that the holding members 38, which are oriented forwards, no longer grip and firmly hold the fin assembly wings 14, but release them. The fin assembly wings 14 can be moved to the overcaliber functional position by the spinning effect. Cutouts 32 have an axial longitudinal extent 40 (see FIG. 3) which is slightly greater than the longitudinal extent 42 of the holding member 38, which is oriented forwards, of the associated holding pin 34.

In the release position, the locking pot 16 remains at the tail 10 of the missile. A stop element 44 is provided for this purpose behind the locking pot 16 at the tail 10 of the missile 12, and defines the release position of the locking pot 16. The stop element 44 is formed by a ring 46, which has an external thread 48. A tail sleeve 50 is attached to the tail 10 of the missile 12, and has an internal threaded section 52 at its rear end. The external thread 48 on the ring 46 is screwed into the internal threaded section 52 in the tail sleeve 50, so that the ring 46 is firmly connected to the tail sleeve 50.

The tail sleeve has longitudinal cutouts 54 (see FIG. 2) parallel to the axis, in each of which an associated bearing element 56 is mounted. Each bearing element 56 extends between a rear collar 58 and a front collar 60 on the tail sleeve 50. Associated with the respective bearing element 56, the rear collar 58 and the front collar 60 have holes 62 and 64, which are axially aligned with one another and are used to hold a bearing shaft 66. The associated fin assembly wing 14 is fitted to the respective bearing shaft 66.

The stop element 44, which is in the form of a ring 46, is at an axially defined distance from the rear tail end surface 22 of the missile tail 10, that is to say the axial distance 68 (see FIG. 3) between the stop element 44 and the pot base 18 of the locking pot 16 (when it is in the holding position) is matched to the difference 70 between the axial longitudinal size 40 of the cutout 32 of the respective fin assembly wing 14 and the axial size 72 of the pin 36 (which projects radially away from the pot casing 20) of the associated holding pin 34, that is to say the axial distance 68 is, for example, slightly less than said difference 70, which is greater than the size 72, so that the fin assembly wings 14 are reliably released when the locking pot 16 is in the release position.

In order to hold the locking pot 16 firmly on the tail 10 of the missile 12, reliably and in a captive manner, when in the release position, the ring 46 on the stop element 44 has an internal diameter 74 which is smaller than the internal diameter 76 of the tail sleeve 50 (see FIG. 3).

The pot casing 20 of the locking pot 16 can move axially between the cylindrical inner surface 78 of the tail sleeve 50 and a cylindrical surface 80 of the tail 10 of the missile 12.

The tail sleeve 50 has elongated holes 82, which correspond to the axially oriented cutouts 32 on the rear edge 30 of the fin assembly wings 14 and are coincident with them.

Figure 2:
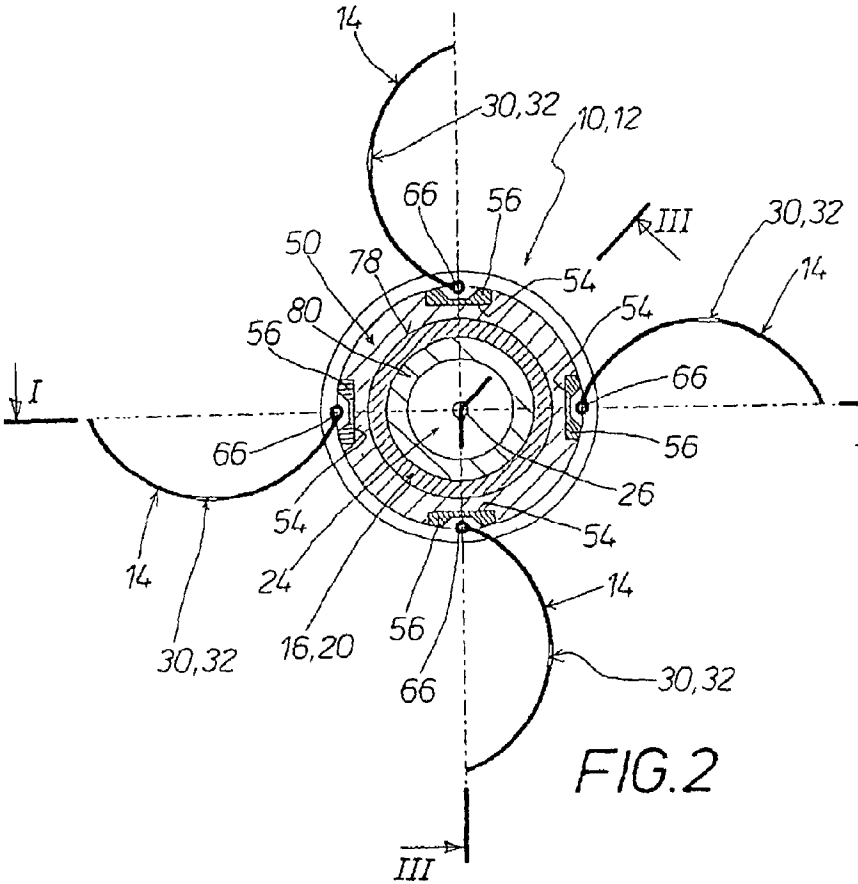
FIG. 2 shows a section along the section line II—II in FIG. 1 through the tail of the missile.

Identical details in FIGS. 1, 2 and 3 are each annotated with the same reference numbers, so that there is no need to describe each of them in detail as individual features in conjunction with all of the figures.

FIG. 4 shows a detail of the upper half of the tail 10 of the missile 12, with the fin assembly wing 14 being held in its subcaliber launch position by means of the associated holding pin 34, which projects radially away from the pot casing 20 of the locking pot 16.

Identical details are annotated with the same reference numbers in FIG. 4 as in FIG. 3, so that there is no need to describe all of these individual figures in detail once again in conjunction with FIG. 4.

FIG. 5 shows a detail of a fin assembly wing 14 with its rear edge 30, which is oriented in the circumferential direction and has an axially oriented cutout 32. The tail sleeve 50 has axially oriented elongated holes 82, through which the pins 36, which project radially away from the pot casing 20 of the locking pot 16, of the holding pins 30 pass (see FIGS. 4 and 5).

Figure 6:
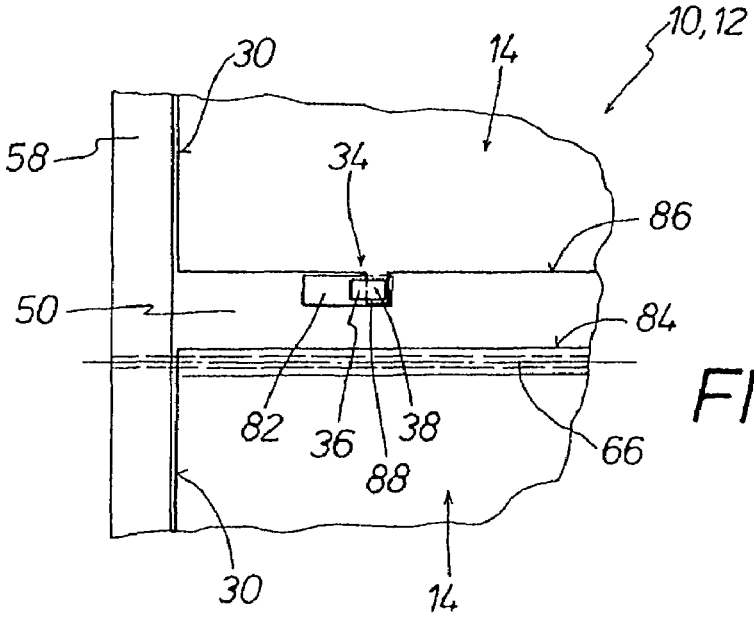
FIG. 6 shows a view, similar to that in FIG. 5, of a detail of another embodiment of the missile.

In comparison to the embodiment shown in FIG. 5, FIG. 6 shows an embodiment of the missile 12 with wrap around fin assembly wings 14, of which the lower fin assembly wing 14 in FIG. 6 is shown, with its bearing shaft 66. Each fin assembly wing 14 has a rear edge 30, a proximal, axially oriented longitudinal edge 84 adjacent to the bearing shaft 66, and a distal, axially oriented longitudinal edge 86 at a distance from it. An attachment 88 projects away from the distal longitudinal edge 86 of the respective fin assembly wing 14 in the circumferential direction. When the fin assembly wings 14 are in the subcaliber launch position, the attachment 88 is held firmly by means of the holding member 38, which is oriented forwards, of the associated holding pin 34 of the locking pot 16. In this embodiment of the missile 12 as well, the holding pin 34 extends through an elongated hole 82 in the tail sleeve 50.

Identical details are once again annotated with the same reference numbers in FIG. 6 as in FIGS. 1 to 5, so that there is no need to describe all of the individual features once again in detail in conjunction with FIG. 6.

Figure 7:
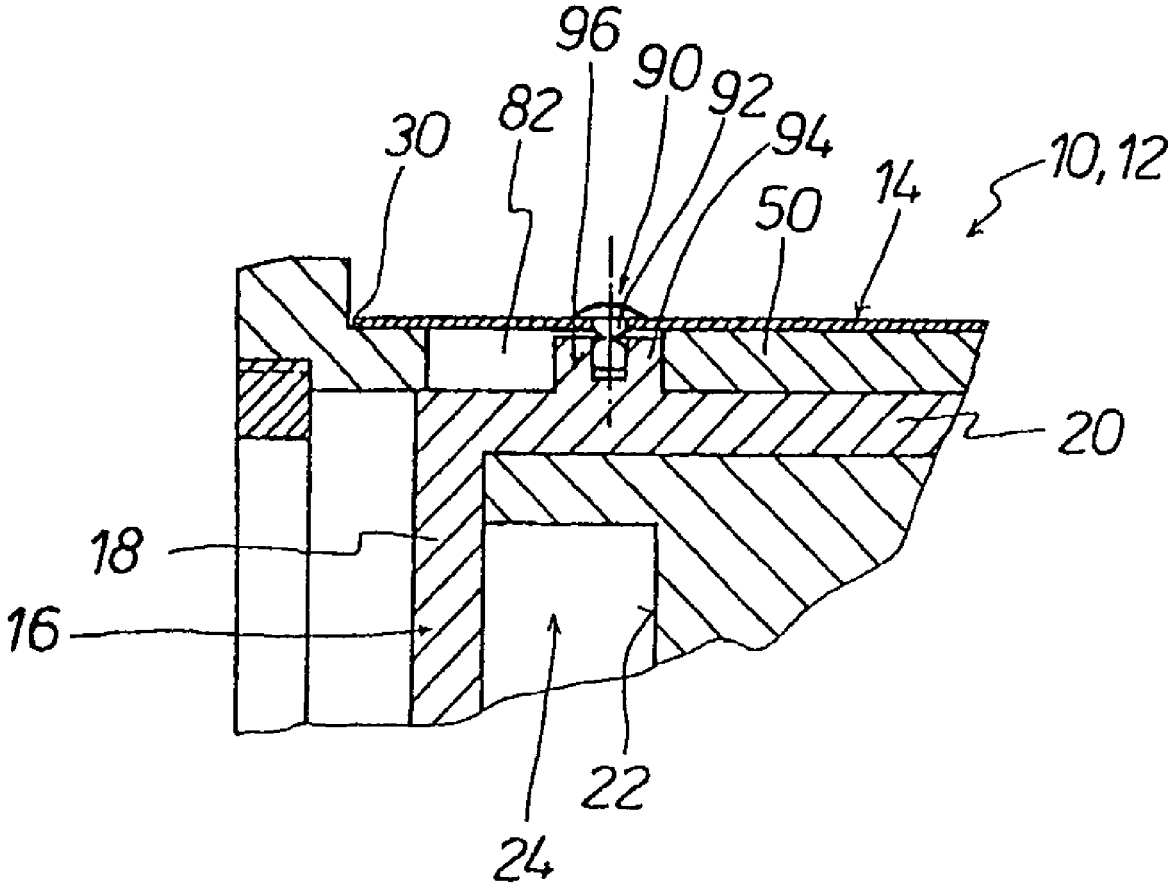
FIG. 7 shows a section illustration through a detail, similar to that in FIG. 4, of yet another embodiment of the missile.

In a detail in the form of a longitudinal section illustration similar to that in FIG. 4, FIG. 7 shows an embodiment of the missile 12 with rear wrap around fin assembly wings 14, of which a detail of one fin assembly wing 14 is illustrated in FIG. 7. A shear pin 90 projects radially inwards from each of the fin assembly wings 14, and each shear pin 90 has a weak point 92.

The pot casing 20 of the locking pot 16 has projections 94 which project away radially and form shearing sections 96, by means of which the shear pins 90 are sheared off at the weak points 92 when the locking pot 16 is moved backwards by the propellant gas pressure in the pressure area 24 when the missile 12 leaves the barrel (which is not shown).

In this embodiment as well, the tail sleeve 50 has elongated holes 82 into which projections 94, which form the shearing sections 96 for the shear pins 90, of the locking pot 16 project.

Identical details are annotated with the same reference numbers in FIG. 7 as in FIGS. 1 to 6, so that there is no need to describe all of these individual features in detail once again in conjunction with FIG. 7.

List of Reference Symbols

10 Tail (of 12)
12 Missile
14 Fin assembly wing (on 10)
16 Locking pot (for 14)
18 Pot base (of 16)
20 Pot casing (of 16)
22 Rear tail end surface (of 10)
24 Pressure area (between 22 and 18)
26 Propellant gas inlet (in 16)
28 Arrow
30 Rear edge (of 14)
32 Cutout (in 30)
34 Holding pin (on 20 for 14)
36 Pin (of 34)
38 Holding member which is oriented forwards (on 36)
40 Longitudinal extent (of 32)
42 Longitudinal extent (of 38)
44 Stop element (on 10 for 16)
46 Ring (of 44)
48 External thread (on 46)
50 Tail sleeve (on 10)
52 Internal threaded section (in 50)
54 Longitudinal cutout (in 50)
56 Bearing element (in 54)
58 Rear collar (on 50)
60 Front collar (on 50)
62 Hole (in 58)
64 Hole (in 60)
66 Bearing shaft (between 62 and 64 for 14)
68 Axial distance (between 44 and 18)
70 Difference (between 40 and 72)
72 Axial size (of 36)
74 Internal diameter (of 44)
76 Internal diameter (of 50)
78 Cylindrical inner surface (of 50)
80 Cylindrical surface (of 10 for 20)
82 Elongated holes (in 50)
84 Proximal longitudinal edge (of 14)
86 Distal longitudinal edge (of 14)
88 Attachment (on 86)
90 Shear pin (on 14)
92 Weak point (of 90)
94 Projection (on 20)
96 Shearing section (for 90)

What is claimed is:

1. A missile to be fired from a barrel, comprising:
a tail having a tail end surface;
a tail sleeve attached to said tail;
a stop element fixed to said tail sleeve;
a movable structural part disposed at said tail;
fin assembly wings to be released from a subcaliber launch position to an overcaliber functional position by said movable structural part moving toward said stop element through a given distance, said fin assembly wings having cutouts formed therein;
a pressure area disposed between said tail end surface and said movable structural part, a propellant gas entering said pressure area during firing of the missile, for moving said movable structural part away from said tail end surface and against said stop element after firing;
bearing shafts supported by said tail sleeve, said fin assembly wings configured as a wrap around tail fin assembly held about said bearing shafts; and
said movable structural part being a locking pot having a base with a propellant gas inlet formed therein, said pressure area disposed in front of said base through which said propellant gas inlet passes, said movable structural part further having a pot casing with holding pins extending into said cutouts in said fin assembly wings.

2. The missile according to claim 1, wherein said tail sleeve has elongated holes formed therein through which said holding pins extend.

3. The missile according to claim 1, wherein said tail sleeve has axially oriented longitudinal cutouts formed therein, and in each of said cutouts of sail tail sleeve one of said bearing shafts is provided for an associated one of said fin assembly wings.

4. The missile according to claim 1, wherein:
said tail has a cylindrical surface; and
said pot casing is disposed between said tail sleeve and said cylindrical surface of said tail.

5. The missile according to claim 1, wherein said holding pins each have a pin which projects radially away from said pot casing and, at a distal end of said pin, said holding pins each have a holding member, which is oriented axially forwards, for engaging said fin assembly wings.

6. The missile according to claim 5, wherein each of said cutouts (32) of said fin assembly wings has a longitudinal extent which is slightly greater than an axial longitudinal extent of a holding member which is provided on a respective one of said holding pins.

7. The missile according to claim 5, wherein each of said fin assembly wings has an attachment disposed on a distal, axially oriented longitudinal edge of said fin assembly wings, with an axial size of said attachment being slightly smaller than said axial longitudinal extent of said holding member of an associated one of said holding pins.

8. The missile according to claim 1, wherein said pot casing has shearing sections; and further comprising shear pins each having a weak point and each projecting radially inwards from a respective one of said fin assembly wings and can be sheared off by a respective one of said shearing sections on said pot casing.

9. The missile according to claim 8, wherein said pot casing has projections projecting radially and form said shearing sections.

10. The missile according to claim 1, wherein said stop element which defines a release position for said locking pot is provided at said tail behind said locking pot and is at an axially defined distance from a rear tail end surface of the missile.

11. The missile according to claim 10, wherein said stop element is formed by a ring attached to a rear end of said tail sleeve, said ring having an internal diameter being less than an external diameter of said tail sleeve.

12. The missile according to claim 11, wherein said tail sleeve has elongated holes formed therein through which said holding pins extend.

13. The missile according to claim 11, wherein said tail sleeve has axially oriented longitudinal cutouts formed therein, in each of said cutouts of said tail sleeve one of said bearing elements is disposed for an associated one of said fin assembly wings.

14. The missile according to claim 11, wherein said pot casing of said locking pot is disposed between an inner surface of said tail sleeve and a cylindrical surface of said tail.

* * * * *

UNITED STATES PATENT AND TRADEMARK OFFICE

CERTIFICATE OF CORRECTION

PATENT NO. : 7,004,425 B2
APPLICATION NO. : 10/504116
DATED : February 28, 2006
INVENTOR(S) : Klaus Bär et al.

It is certified that error appears in the above-identified patent and that said Letters Patent is hereby corrected as shown below:

On the title page Item [12] should read as follows:

UNITED STATES PATENT
Bär et al.

On the title page item [54] and col. 1, line 1, should read as follows:

PROJECTILE BODY FOR FIRING FROM A BARREL WITH OVER-CALIBER GUIDE MECHANISM

On the title page Item [75] should read as follows:

Klaus Bär, Lauf (DE)
Thomas Leidenberger, Eckenta (DE)
Jürgen Bohl, Eckenhaid (DE)

Signed and Sealed this

Thirtieth Day of January, 2007

JON W. DUDAS
*Director of the United States Patent and Trademark Office*